US008720129B2

(12) United States Patent
Sias et al.

(10) Patent No.: US 8,720,129 B2
(45) Date of Patent: May 13, 2014

(54) COMPONENT HOIST CLIP

(75) Inventors: Stanley K. Sias, Hudson, WI (US); Kelly J. Sias, Hudson, WI (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

(21) Appl. No.: 13/369,133

(22) Filed: Feb. 8, 2012

(65) Prior Publication Data

US 2013/0199110 A1 Aug. 8, 2013

(51) Int. Cl.

| | |
|---|---|
| ***E02D 35/00*** | (2006.01) |
| ***E04G 21/14*** | (2006.01) |
| ***E04B 2/70*** | (2006.01) |
| ***E04B 1/35*** | (2006.01) |

(52) U.S. Cl.
CPC .. *E04B 2/70* (2013.01); *E04B 1/355* (2013.01)
USPC ..... 52/125.2; 52/699

(58) Field of Classification Search
USPC ..... 52/92.2, 122.1, 125.2, 125.3, 698, 699
See application file for complete search history.

(56) References Cited

U.S. PATENT DOCUMENTS

| | | | | |
|---|---|---|---|---|
| 1,175,802 | A | 3/1916 | Orcutt | |
| 1,373,036 | A | 3/1921 | Upson | |
| 1,826,133 | A | 10/1931 | Hatch | |
| 2,241,657 | A | 5/1941 | Dehring | |
| 2,831,222 | A | 4/1958 | Anderson | |
| 3,388,518 | A | 6/1968 | Scott | |
| 4,000,596 | A | 1/1977 | Magill et al. | |
| 4,417,431 | A | 11/1983 | Commins et al. | |
| 4,467,579 | A | 8/1984 | Weinar | |
| 4,736,917 | A | 4/1988 | Thuresson | |
| 4,811,475 | A | 3/1989 | Morton, Jr. | |
| 4,831,808 | A | 5/1989 | Wynar | |
| 5,697,725 | A | 12/1997 | Ballash et al. | |
| 6,481,165 | B1 * | 11/2002 | Romary et al. | 52/122.1 |
| 6,560,943 | B1 * | 5/2003 | Leek et al. | 52/715 |
| 6,843,028 | B2 | 1/2005 | Weels | |
| 7,356,973 | B2 * | 4/2008 | Roesset et al. | 52/712 |
| 2007/0044421 | A1 * | 3/2007 | Nguyen | 52/698 |

OTHER PUBLICATIONS

USP Structural Connectors, Hoist Plates—T Series, Webshot, 2009, USP Structural Connectors Full Line Catalog, USA.
USP Structual Connectors, Hoist Plates—T10, Catalog, 2011, 190, USP Structural Connectors Professional Design Manual and Product Catalog, USA.
Cleveland Steel Specialty Co., Hoist Clip, Catalog, 2002, 41, Cleveland Steel Specialty Co. Catalog, USA.

* cited by examiner

*Primary Examiner* — Charles A Fox
*Assistant Examiner* — Patrick Maestri
(74) *Attorney, Agent, or Firm* — James R. Cypher; Charles R. Cypher

(57) ABSTRACT

A connection between a hoist and a wall is provided wherein a clip connects a sling of the hoist to the wall, and the clip includes a plate portion having an eye opening receiving the sling. The clip also includes a tongue portion extending from the plate portion, the plate portion lying in registration with the outer side surface of the wall, and the clip also includes an extension flange, extending from and connected to the plate portion at an angle thereto and at an angle to the tongue portion. The extension flange is disposed in registration with the top surface of the wall. Fasteners connect the tongue portion of the clip to the outer side surface of the wall and connect the extension flange to the top surface of the wall.

10 Claims, 5 Drawing Sheets

COMPONENT HOIST CLIP

BACKGROUND OF THE INVENTION

The present invention relates generally to the field of light frame construction, and in particular to a clip that can be attached to a pre-built portion of a wall or other member to allow the member to be attached to a hoist and lifted.

In light frame construction it is a common practice to build the walls of the structure lying down on a flat surface and then to lift or tilt them upright and into place. The walls can be constructed on site on the floor of the structure, or they can be built off-site in a factory and then transported to the site. In either case, after the wall or a portion of a wall has been completed, it needs to be lifted upright, moved into place and secured to the structure. The present invention provides a clip that can be attached to the wall at its top, which in turn is connected to a sling or chord which is in turn attached to a hoist for lifting the wall.

Similar clips are available commercially. The clip of the present invention improves upon the prior art by providing clip that is easy and economical to use, makes a strong connection to the wall so as to protect the wall from damage during lifting, and can be reused along with the fasteners used to connect it to the wall.

SUMMARY OF THE INVENTION

It is an object of this invention to provide a secure connection between a hoist and a wall wherein a clip connects a sling of the hoist to the wall, and the clip includes a plate portion having an eye opening receiving the sling. The clip also includes a tongue portion extending from the plate portion, the plate portion lying in registration with the outer side surface of the wall, and the clip also includes an extension flange, extending from and connected to the plate portion at an angle thereto and at an angle to the tongue portion. The extension flange is disposed in registration with the top surface of the wall. Fasteners connect the tongue portion of the clip to the outer side surface of the wall and connect the extension flange to the top surface of the wall. The object of achieving a secure connection is achieved in part by anchoring the clip to both the top surface and outer side surface of the wall. The object of achieving a secure connection is achieved in part by using threaded fasteners. The object of achieving a secure connection is also achieved in part by connecting the extension flange and the tongue portion to the wall with fasteners that are disposed at an angle to each other, preferably a right angle. The object of achieving a secure connection is achieved in part by using separate fasteners to connect the tongue portion of the clip to both members of the top plate, if the top plate is made from more than one member. The object of achieving a secure connection is accomplished in party by using a clip that has two side extension flanges that are spaced from each other on either side of the tongue portion of the clip.

It is also an object of the present invention to provide a clip that will not deform when loaded or damage the wall. This object is achieve in part by forming the clip with an upper plate portion, a tongue portion extending therefrom and one or more extension flanges extending at an angle to both the plate portion and the tongue portion, and securing the tongue portion and the extension flanges to the wall with fasteners, preferably threaded fasteners. This object is also achieved in part by forming gussets between the one or more extension flanges and the upper portion of the clip.

It is also an object of the present invention to provide a clip that is easy to install and can be reused. This object is achieved in part by using relatively few strong fasteners that can easily be installed and removed with a common power driver.

It is also an object of the present invention to provide a clip that is economical to manufacture. This object is achieved in part by forming the clip in a manner that can it be made from sheet metal on an automated die press with a minimum of waste of the sheet stock.

BRIEF DESCRIPTION OF THE FIGURES

FIG. 6 is a side view of the present invention. The opposite side view is similar.

DETAILED DESCRIPTION OF THE INVENTION

Figure 1B:
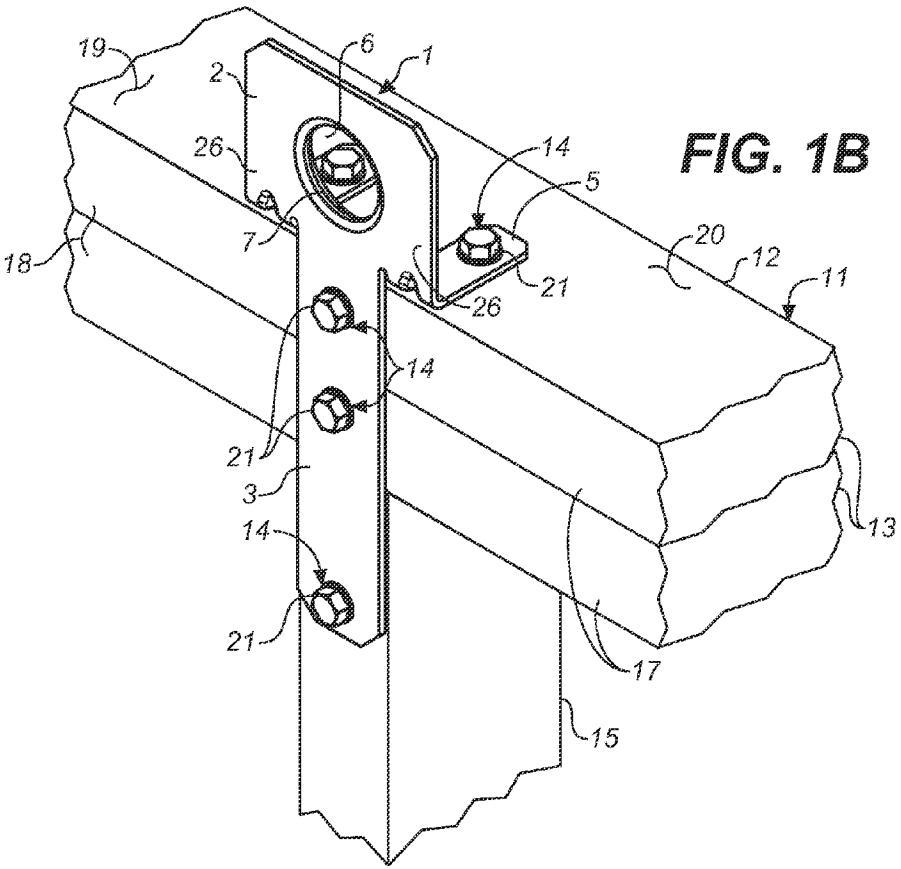
FIG. 1B is a perspective view of the clip of the present invention attached to a wall with fasteners.
Figure 1A:
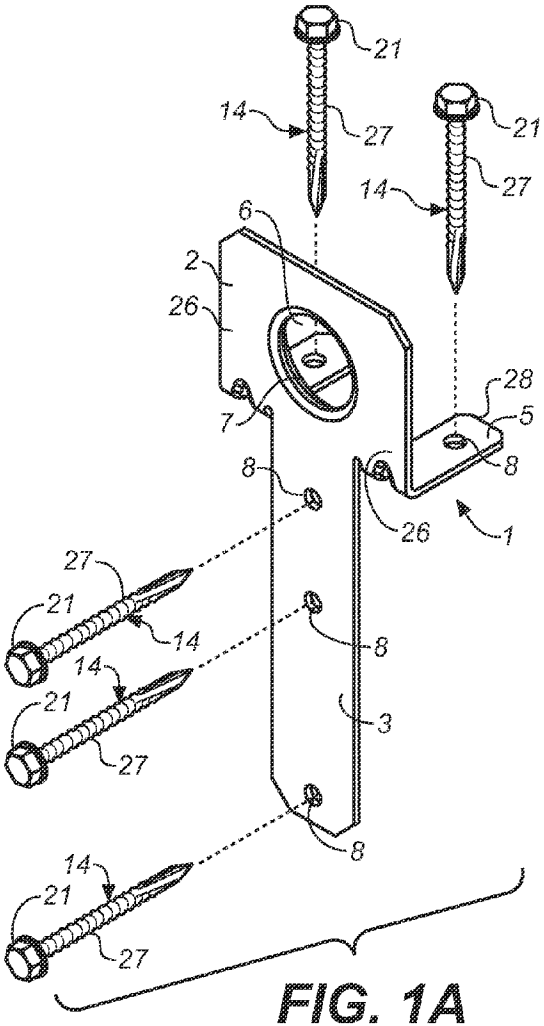
FIG. 1A is a perspective view of the clip of the present invention with the fasteners that would be used to connect it to a wall.
Figure 2A:
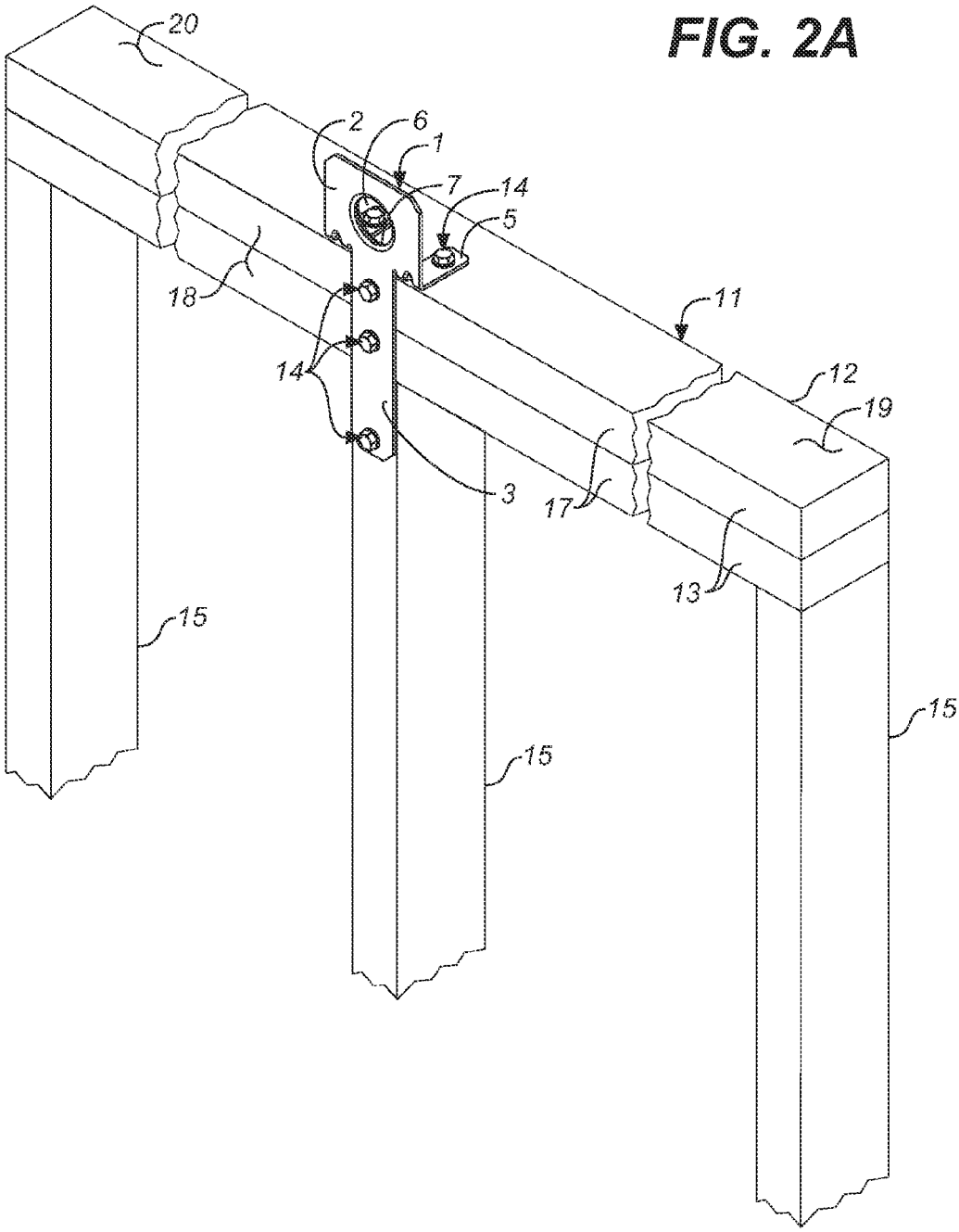
FIG. 2A is a perspective view of the connection of the present invention.
Figure 2B:
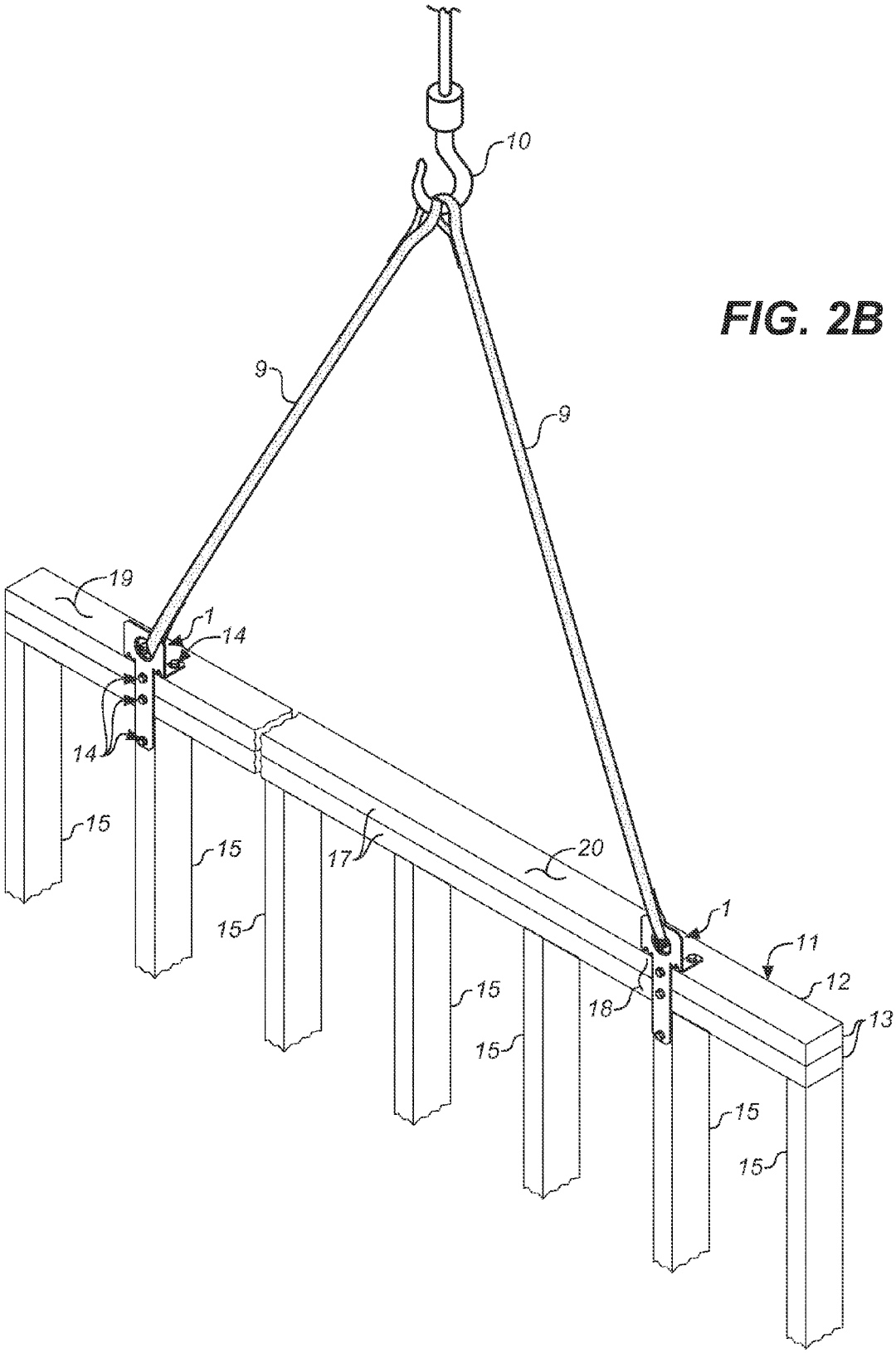
FIG. 2B is a perspective view of the connection of the present invention.
Figure 3:
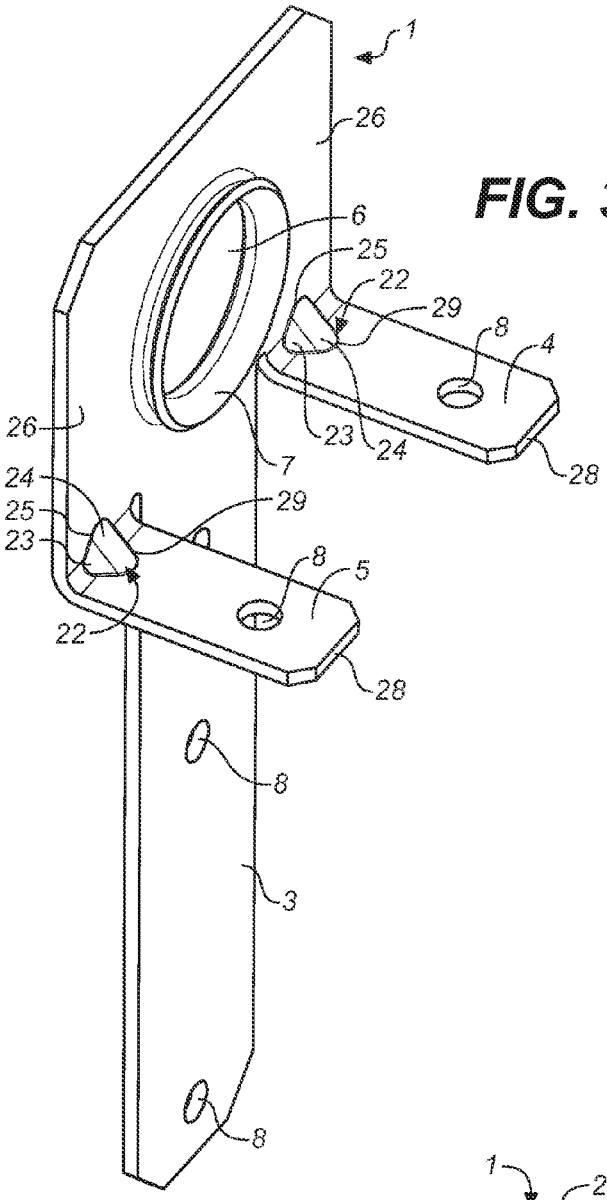
FIG. 3 is a perspective view of the clip of the present invention.
Figure 4:
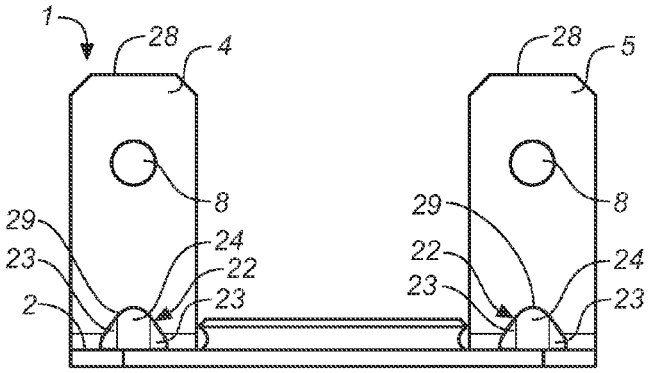
FIG. 4 is a top view of the clip of the present invention.
Figure 5:
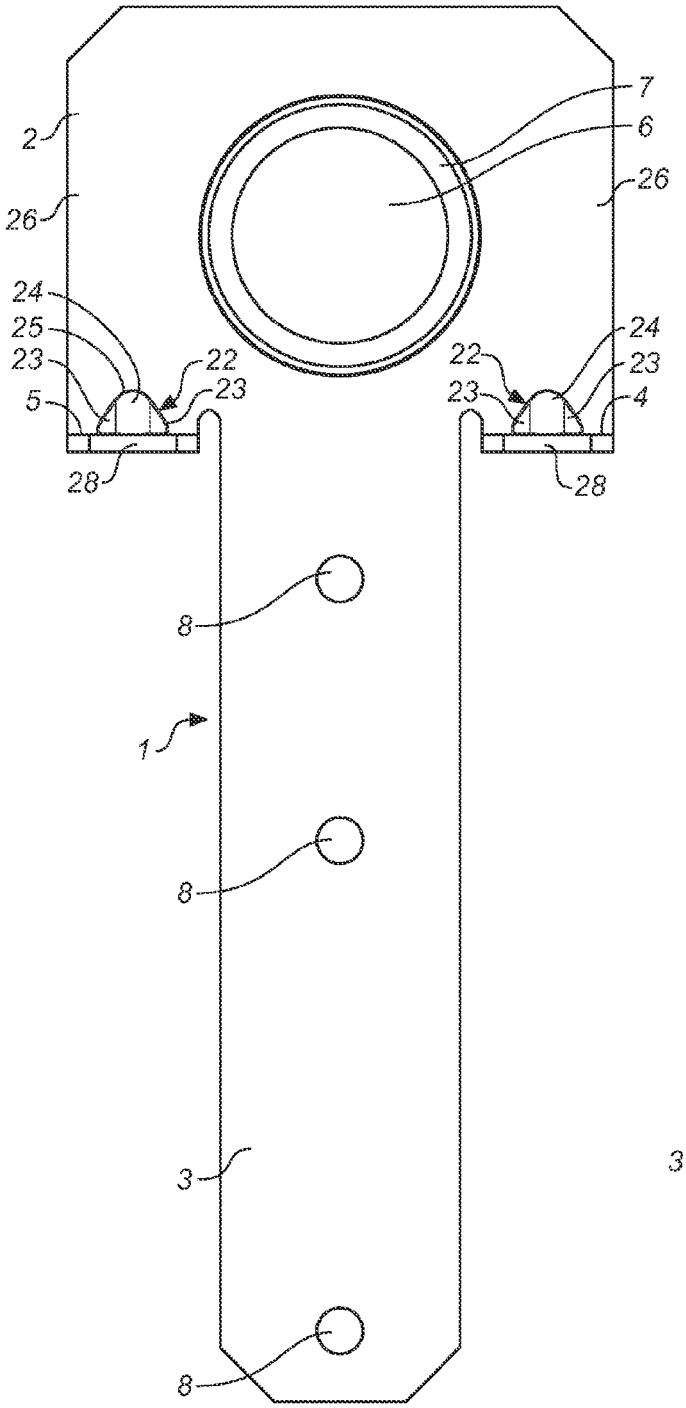
FIG. 5 is a front view of the clip of the present invention.
Figure 6:
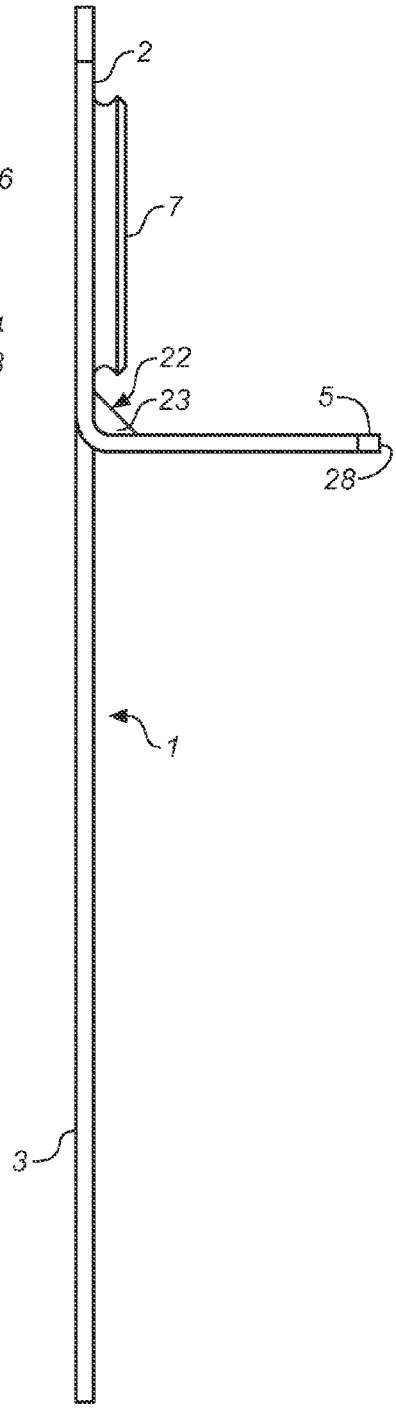

Referring to FIG. 1, a component hoist clip 1 is shown formed of a single sheet of material, preferably from sheet steel with a thickness and strength to resist bending of the clip 1 under the design load forces. The clip 1 has a plate portion 2, and a tongue portion 3 extending from the plate portion 2. Preferably the plate portion 2 and the tongue portion 3 are substantially planar members and extend in substantially the same plane. The preferred clip 1 is also formed with a pair of first and second extension flanges 4 and 5 extending at an angle from the plate portion 2. Preferably the extension flanges 4 and 5 are extensions of the plate portion 2 and extend at a right angle to both the plate portion 3 and the tongue portion 3. Preferably the first and second extension flanges 4 and 5 are spaced apart from each other by the tongue portion 3. Preferably, the first and second extension flanges 4 and 5 are not connected, except through the plate portion 2.

In the preferred embodiment, the tongue portion is substantially wider than either the first or second extension flanges 4 or 5.

Preferably, the plate potion 2 is formed with a wide eye or hoist opening 6, having a beveled edge 7, and is also formed with fastener openings 8 in the first and second extension flanges 4 and 5 and the tongue portion 3. Preferably, a fastener opening is formed in each of the extension flanges 4 and 5, and three spaced fastener openings 8 are formed in the tongue portion 3.

The preferred embodiment of the clip 1 of the present invention joins to lifting slings or straps 9 which are connected to a hoist 10 which is used to raise a standard-framed stud wall 11 built with standard lumber sizes used in the United States. It is common practice in the United States to build a stud wall 11 with a top plate 12 built with two layers of standard width wood members 13. The top plate 12 is preferably formed with a lower and an upper framing member 13, with the upper framing 13 member connected to and resting upon the lower framing member 13. In the preferred form of the clip 1, the fastener openings 8 on the tongue portion 3 are located such that a fastener 14, preferably a threaded fastener, is driven into each of the members 13 that make up the doubled top plate 12, and an additional fastener 14 is driven into an upright stud 15 connected to the top plate 12 at an angle thereto, preferably a right angle. In the preferred or typical installation, these fasteners 14 that are driven through the tongue portion 3 are driven into the narrow sides 17 of the members 13 that make up the top plate 12 and the upright stud 15. These fasteners 14 are also driven into the outer side surface 18 of the top plate 12 or wall 11. The fasteners 14 that are driven through the extension flanges 4 and 5 are driven through the wide side surfaces 19 of the members 13 that make up the top plate 12. These fasteners 14 are driven through top surface 20 of the top plate 12 and the wall 11. Preferably, these fasteners 14 that are driven through the top surface 20 of the top plate 12 connect to both members 13 that make up the top plate 12. The fasteners 14 driven through the extension flanges 4 and 5 are preferably disposed at a right angle to the fasteners 14 driven through the tongue portion 3. The combination of the two fasteners 14 driven through the extension flanges 4 and 5 down into the top plate 12, the two fasteners driven into the top plate 12 through the tongue portion 3, and the additional fastener 14 in the upright stud 15, make a strong connection to the stud wall 11, such that wall 11 will not be damaged when it is lifted at this point by means of the clip 1.

In the preferred embodiment, the clip 1 is attached to the wall with the plate portion 2 extending above the top surface 20 of the wall 11.

Preferably, the fasteners 14 that are used are self-drilling wood fasteners with a hexagonal head 21 that allows the fasteners to easily be driven with a power tool. Furthermore, self-drilling wood fasteners 14 can easily be removed once the stud wall 11 has been lifted into place, and the fasteners 14 and clip 1 can be reused.

Preferably, as is best shown in FIGS. 3, 4, 5 and 6, at the interface between the plate portion 2 and the first and second extension flanges 4 and 5, gussets 22 are formed to strengthen the first and second extension flanges 4 and 5. The clip 1 is formed in a manner such that portions of the plate portion 2 of the clip 1 are disposed above and in alignment with the first and second extension flanges 4 and 5, such that these upper or overlying portions of the plate portion 2 are joined to first and second extension flanges 4 and 5 by these gussets 22. The gussets 22 are preferably formed with two substantially planar triangular sections 23 meeting at a rib juncture 24. Each rib juncture extends from the first or second extension flange 4 or 5 to the plate portion 2. Similarly the upper side edge 25 of each triangular section 23 is joined to a portion of the plate portion 2 and the lower side edge 29 of each triangular section 23 is joined to either the first or second extension flange 4 or 5. By providing overlying upper plate portions 26 to which gussets 22 can be connected, gussets 22 can be provided for securing the connection of the first and second extension flanges 4 and 5 that do not interfere with the connection to the wall 11.

The gussets 22 provide the clip 1 with rigidity and help to keep it from deforming when under load. It is important for the integrity of the stud wall 11 and the ability to reuse the clip 1 that the clip 1 not pull away from the wall 11 or deform when under load. In the preferred form of the clip 1, relatively few fasteners 14 are used, and yet the fasteners 14 used are sufficient in bending strength and pull-out resistance to hold the clip 1 in place without deformation of the clip 1, pull-out of the fasteners 14 or deformation of the wall 11. Relatively few fasteners 14 can be used, because, preferably, threaded fasteners 14 with a shank 27, having a relatively large diameter are used, and the fasteners 14 are inserted through the top surface 20 of the top plate 12 as well as being inserted through the outer side wall or surface 18 of the top plate 12, providing resistance to the lifting forces at two different angles. Because threaded fasteners 14 are preferably used the fasteners 14 are more resistant to pull-out than nails, and yet can be easily unscrewed from the wall 11 as needed.

The clip 1 of the present invention is economical to manufacture, because it can be produced on an automated die with minimal waste of material. The die for the clip 1 can be set up so that clips 1 can be cut from the material in side-by-side, but oppositely oriented fashion, such that the tongue portion 3 of one clip 1 lies adjacent the plate portion 2 of the clips 1 to either side of it, and the end 28 of the extension flange 4 or 5 of one clip 1 abuts the end 28 of the extension flange 4 or 5 of the oppositely disposed clip 1 next to it.

We claim:

1. A system for lifting a wall, the system comprising:

a. a hoist, having at least one sling;

b. a wall having a top surface and an outer side surface;

c. a clip connected to the wall and the hoist, the clip comprising:

i. a substantially planar plate portion having an eye opening, the eye opening receiving the at least one sling connected to the hoist and the plate portion extending above the top surface of the wall;

ii. a substantially planar tongue portion extending from and connected to the plate portion, part of the plate portion also lying in registration with the outer side surface of the wall, with the tongue portion having a plurality of fastener openings and also lying in registration with the outer side surface of the wall;

iii. at least one substantially planar extension flange, extending from and connected to the plate portion at an angle thereto and at an angle to the tongue portion, the at least one extension flange being disposed in registration with the top surface of the wall, the at least one extension flange being formed with a single fastener opening that is closer to the end of the extension flange than the plate portion, wherein the clip is in registration with only the outer side surface and the top surface of the wall; and d. fasteners connecting the tongue portion of the clip to the outer side surface of the wall; and a single fastener connecting each of the at least one extension flange to the top surface of the wall, and wherein the fastener openings in the tongue portion are in substantial alignment and are the only fastener openings in the clip that receive fasteners that couple the clip to the outer side surface of the wall and the fastener opening in the tongue that is closest to the eye opening in the plate portion of the clip is below the at least one extension flange, wherein no more than five fasteners are used to connect the clip to the wall.

2. The system of claim 1, wherein:

the fasteners are threaded.

3. The system of claim 2, wherein:

a. the wall comprises a top plate formed of a lower and an upper framing member, with the upper framing member connected to and resting upon the lower framing member; and b. a single fastener connects the tongue portion to the upper framing member and a second, different single fastener connects the tongue portion to the lower framing member.

4. The system of claim 3, wherein:

a. the wall further comprises an upright stud set at an angle to the top plate and connected to the top plate at an angle thereto; and b. a single fastener connects the tongue portion to the upright stud.

5. The system of claim 4, wherein:

a. the clip is formed with only a first extension flange and a separate, second extension flange, and b. a single fastener connects each extension flange to the top surface of the wall.

6. The system of claim 5, wherein:

the first and second extension flange are disposed below overlying portions of the upper portion of the clip.

7. The system of claim 6, wherein:

a. gussets connect each of the first and second extension flanges to the corresponding overlaying portion of the upper portions of the clip.

8. The system of claim 7, wherein:

a. each gusset is formed with two substantially planar triangular sections meeting at a rib juncture, each triangular section having a upper side edge and a lower side edge, and each rib juncture extends from the first or second extension flange to the plate portion, and the upper side edge of each triangular section is joined to a portion of the plate portion and the lower side edge of each triangular section is joined to either the first or second extension flange.

9. The system of claim 8, wherein:

a. the fasteners connecting the tongue portion to the outer side surface of the wall are orthogonal to the fasteners connecting the first and second extension flanges to the top surface of the wall.

10. The system of claim 9, wherein:

the first and second extension flanges are disposed to the sides of the tongue portion and are spaced from each other.

* * * * *